United States Patent [19]

Berger

[11] Patent Number: 4,583,617

[45] Date of Patent: Apr. 22, 1986

[54] RESCUE BASKET

[76] Inventor: Per Berger, N-1154, Oslo 1, Norway

[21] Appl. No.: 675,243

[22] Filed: Nov. 26, 1984

[30] Foreign Application Priority Data

Dec. 6, 1983 [NO] Norway ..... 834473

[51] Int. Cl.[4] ..... B63C 9/00

[52] U.S. Cl. ..... 182/142; 182/150; 182/222; 244/137 P

[58] Field of Search ..... 182/142, 150, 222; 244/137 P

[56] References Cited

U.S. PATENT DOCUMENTS

| | | | |
|---|---|---|---|
| 581,197 | 4/1897 | Cook | 182/142 |
| 598,294 | 2/1898 | Robbins | 182/142 |
| 636,689 | 11/1899 | Nichols et al. | 182/142 |
| 773,000 | 10/1904 | Canfield | 182/142 |
| 2,700,781 | 2/1955 | Smith | 244/137 P |
| 2,817,860 | 12/1957 | Fritz | 244/137 P |
| 3,036,315 | 5/1962 | Karnow | 244/137 P |
| 3,228,044 | 1/1966 | Mattenson | 244/137 P |

*Primary Examiner*—Reinaldo P. Machado
*Attorney, Agent, or Firm*—Young & Thompson

[57] ABSTRACT

A rescue basket is provided with a centrally placed guide tube extending upwardly from the bottom of the basket, thereby forming a guide for a handling wire which extends through the tube and under the basket is connected to a weight.

2 Claims, 2 Drawing Figures

RESCUE BASKET

Figure 1:
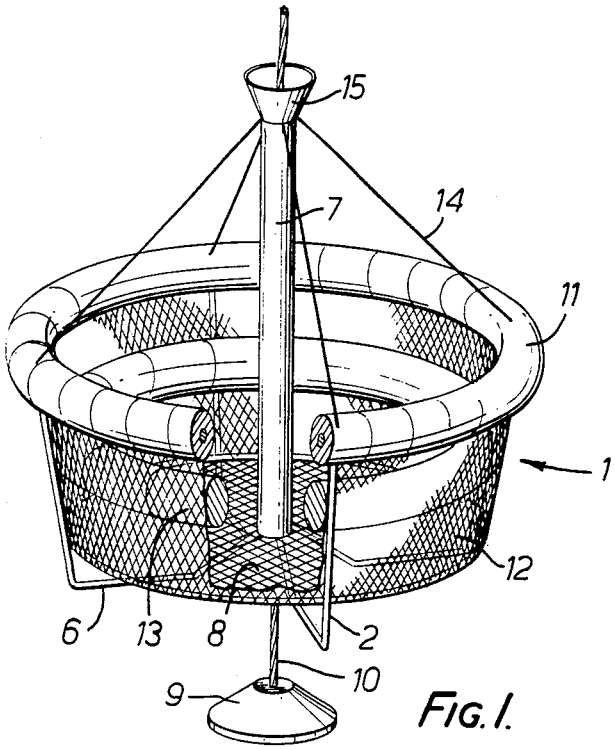

The present invention relates to a rescue basket for life saving in man overboard situations or by other accidents.

A rescue basket may have various forms, a main concept, however, comprises a circular basket structure having a grid or net bottom and a peripheral wall provided with buoyancy means, cushion padding etc., the basket being connectable to a lowering or retrieval cable, the other end of which is connected to a davit or crane structure onboard a vessel, a main platform—floating or the gravity type, a helicopter or the like. An inherent disadvantage is that the cable becomes slack due to the swell of the sea, whereby the cable, the connector—e.g. a hook, an eventual swivel and the like represent a clear potential danger for the person or persons in the rescue basket.

A slackening of the wire may be prevented provided the wire is lead through a guide in the basket, the end of the cable thus protruding down from under the basket being weighted. The weighted cable will then always be taut, whereas the basket may follow the movement of the sea.

A such weighted cable guidance is f.i. known from U.S. Pat. No. 2,103,708 in connection with the handling of boats. The content of this patent publication is incorporated by reference in the present application.

The provision of the weighted wire guidance is, however, not completely satisfactory. The cable still represents a potential danger to a person or persons onboard the rescue basket and although kept taut by the weight it may still go slack when the rescue basket is set onto a deck surface. The cable may also by accident run out from the davit or crane structure, thereby being caught or braked non-intentionally in the guide onboard the rescure basket with a potential danger of hitting the near-by personnel.

The object of the present invention is to improve a rescue basket which is handled by means of a weighted cable, thereby giving the personnel a still better protection.

In accordance with the invention the guide for the cable on the rescue basket is provided in the form of a centrally in the rescue basket arranged and from the basket bottom upwardly extending tubular guide means, the said guide means extending to a such height above the basket bottom that a slackening of the cable only will result in the wire bending outwardly and eventually hit the outside of the basket wall, without personnel sitting in the basket.

Preferably the tubular guide means is in the form of a regular tube. The tubular guide means viz. the tube may preferably be guyed by means of shrouds extending upwards from the basket wall.

The height of the tubular guide above the basket bottom will depend on the overall dimensions of the rescue basket.

For a basket bottom diameter of about 2 m and a basket wall height of about 1 m the central tubular guide should have a height from the basket bottom of about 2 m or more.

The bottom structure of the basket is preferably provided with a recess for receiving the cable weight, thus providing a stable surface for placing the rescue basket on a deck. The upper part of the tubular guide may preferably be flared upwards in order to protect the wire in this area.

Figure 2:
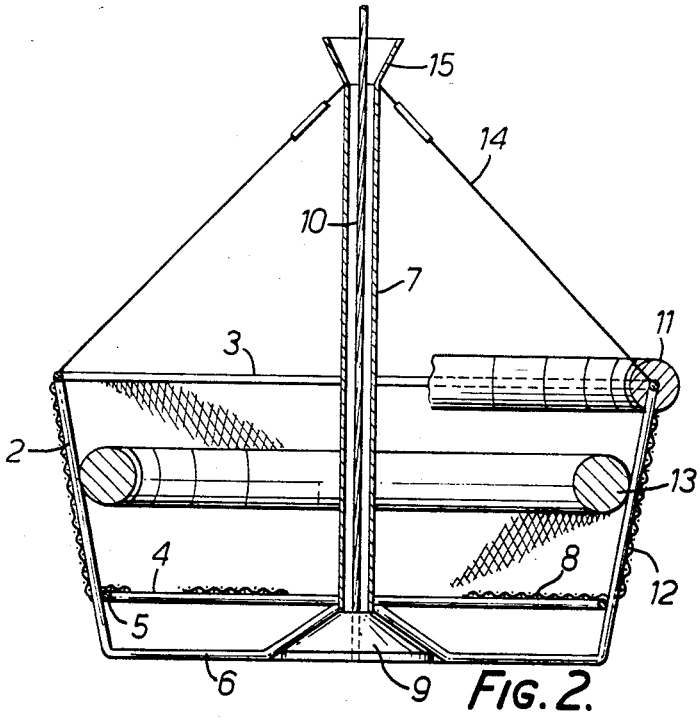

A preferred embodiment of the invention will be described below with reference to the drawing wherein:

FIG. 1 is a partly away perspective view of a rescue basket according to the invention, and FIG. 2 is a section through the rescue basket in FIG. 1.

The rescue basket 1 consists of a framework made up of sea water resistant aluminium tube elements 2, 3, 4, 5, and 6 welded together to form a cage structure. The tube element 3 is formed to a circular ring wherefrom four equidistant arranged tube elements 2 extend downwards to a circular ring made up by a tube element 4. The tube elements 2 extend further down beyond this bottom ring 4 and are connected with horizontal inwardly extending tube elements 6 which meet at the central area of the ring, where they are joined to a vertically extending tube 7. Spokelike tube elements 4 extend inwards from the bottom ring 6 and meet with the tube 7, thus forming a support structure for a metal grid bottom 8 provides support for passengers.

As shown in FIG. 2 the lowermost spokes 6 are bent upwards in the central area towards the tube 7, thus forming a recess for a weight 9. This weight 9 is connected with a handling and guiding cable 10 extending through the central tube 7. In the position shown in FIG. 2 the weight is received in the recess so that the tube elements 6 together define a plane bottom surface enabling a stable placing of the rescue basket on a deck.

The upper ring 3 is provided with buoyancy bodies 11. A metal grid 12 is fastened to the tube elements 2, thus forming a basket wall. In a suitable height of the wall is arranged a cushion 13 which extends continuously around the inside of the wall. The buoyancy bodies 11 also extend continuously around the basket upper periphery, see FIG. 1.

The upper part of the central guide tube 7 is flared at 15 to protect the wire against chafing in this area. Shrouds 14 act to stabilize and guy the central tube 7.

Having described my invention, I claim:

1. A marine rescue basket having a bottom and a peripheral wall, a central downwardly opening recess in said bottom, a centrally arranged tubular means fastened to and extending upwardly from the said bottom, the said tubular means forming a guide for a cable extending through the tubular means and beyond the bottom and being connected to a weight means having such dimensions that it may be totally received in said recess, but cannot pass through said tubular guide means, the other end of the cable being adapted to be connected to structure such that the cable acts as a lowering and retrieval cable for said marine rescue basket, the said tubular guide means being of such a height above the said bottom that a slackening of said cable will result in the cable bending outwardly and eventually hitting the outside of said peripheral wall, the tubular guide means being shrouded with stays extending from said peripheral wall.

2. A marine rescue basket as claimed in claim 1, having said and bottom walls comprised by a plurality of tubular elements connected together to form a cage structure, said tubular elements having upright portions forming side walls of the cage structure and horizontal inwardly extending portions forming a bottom of the cage structure, said horizontal inwardly extending portions being bent upwardly adjacent the center of the basket to define said recess.

* * * * *